United States Patent [19]

Medlock

[11] Patent Number: 4,526,373

[45] Date of Patent: Jul. 2, 1985

[54] GOLF CLUB SWING TRAINING DEVICE

[76] Inventor: Alfred A. Medlock, P.O. Box 627, Ocean Springs, Miss. 39564

[21] Appl. No.: 523,881

[22] Filed: Aug. 17, 1983

[51] Int. Cl.[3] ..... A63B 69/36

[52] U.S. Cl. ..... 273/186 R; 273/177 R; 273/195 R; 273/183 A

[58] Field of Search ..... 273/186 R, 186 C, 200 R, 273/196, 427, 183 A, 177 A, 177 B, 177 R, 388, 389, 181 A, 195 R; 15/30, 160, 161

[56] References Cited

U.S. PATENT DOCUMENTS

| | | | |
|---|---|---|---|
| 606,184 | 6/1898 | Burnip | 15/160 |
| 2,712,939 | 7/1955 | Harp | 273/186 R |
| 3,429,577 | 2/1969 | Godden | 273/186 R |
| 3,572,720 | 3/1971 | Berg | 273/186 C |

FOREIGN PATENT DOCUMENTS

| | | | |
|---|---|---|---|
| 383767 | 11/1932 | United Kingdom | 273/186 R |

*Primary Examiner*—George J. Marlo
*Attorney, Agent, or Firm*—Harvey B. Jacobson; Clarence A. O'Brien

[57] ABSTRACT

A golfing aid comprises a U-shaped tube having elongate arms with upstanding flexible fingers spaced along the length of each arm. The tube is positioned on the ground in juxtaposition to a golf ball with the arms straddling the intended clubhead swing path and providing guidance to a golfer of the intended swing path. In use, if the clubhead brushes the resilient fingers, an indication is provided to the golfer that the clubhead has strayed from the required path. The device also includes a pointer for aligning the arms in relation to a target in accordance with the type of shot to be made. The tube is flexible with a stiffening wire extending therethrough, and the flexible fingers comprise lengths of tubing secured by screws in diametrically opposed holes formed in the tube.

13 Claims, 7 Drawing Figures

GOLF CLUB SWING TRAINING DEVICE

BACKGROUND OF THE INVENTION

This invention relates to a golfing aid which can be used with advantage for providing swing path and alignment guidance to a golfer, for executing selected types of shots, such as draws, fades, or straight shots, and which can also be used for putting practice.

SUMMARY OF THE INVENTION

The invention provides a relatively lightweight, readily transportable golfing aid, which can be used by a golfer for practicing, for teaching or training purposes and the like, both outdoors and indoors, more particularly for providing swing path and alignment guidance, but which can also be used as a target particularly for putting and chipping.

In one preferred form of the invention, for example, the aid comprises a guide structure comprising a tube which can be bent into the shape of a U to provide a pair of spaced elongate arms adapted for placement on the ground in juxtaposition to a golf ball, with the arms straddling an intended clubhead swing path. The arms may each include resilient upstanding indicating members for providing an indication to a golfer, when brushed by a clubhead, that the clubhead has strayed from the intended swing path, and the device may also include a pointer for providing alignment of the arms relative to a target, to suit a particular shape of shot to be played.

The invention provides a versatile golfing aid which may be readily carried by a golfer, for example, in a golf bag, and which can be placed on the ground in requisite alignment in relation to a target for providing swing path guidance to the golfer in executing different types of shots, for example, straight shots, drawn shots, or fades. The device may also be used in putting and chipping, either hitting out of the guide structure with the arms being used for stroke guidance, or using the device as a cup or target to hit into.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
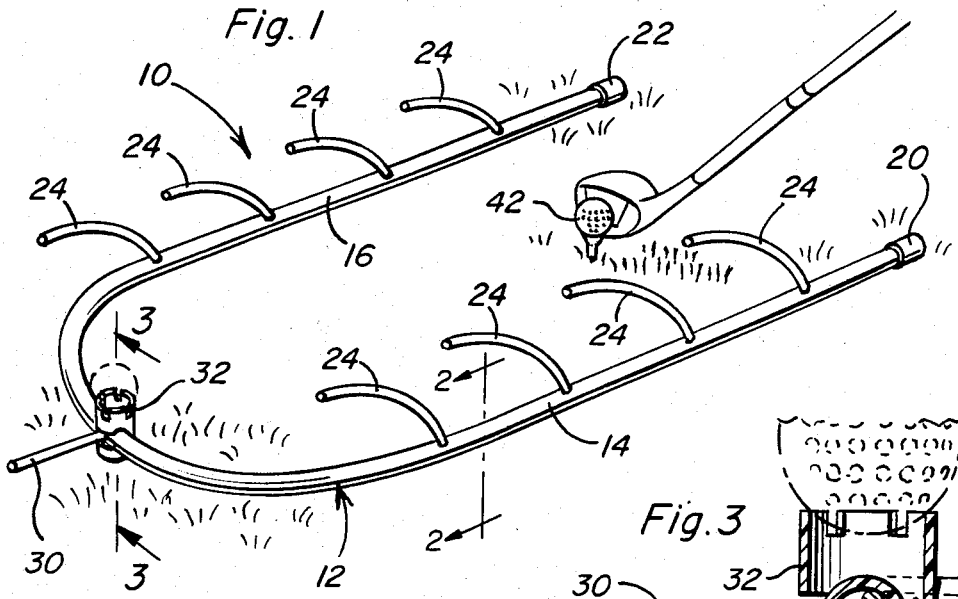
FIG. 1 is a perspective view of a golf training aid in accordance with the invention shown in operative position in relation to a golf ball and club.
Figure 2:
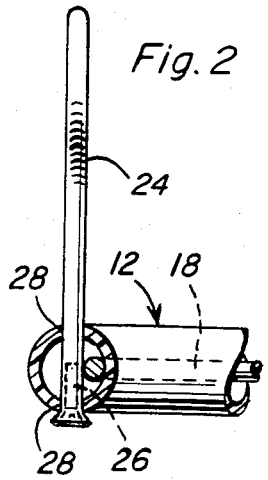
FIG. 2 is a cross-sectional view, to an enlarged scale, of a part of the training aid, and taken on line 2—2 of FIG. 1.
Figure 3:
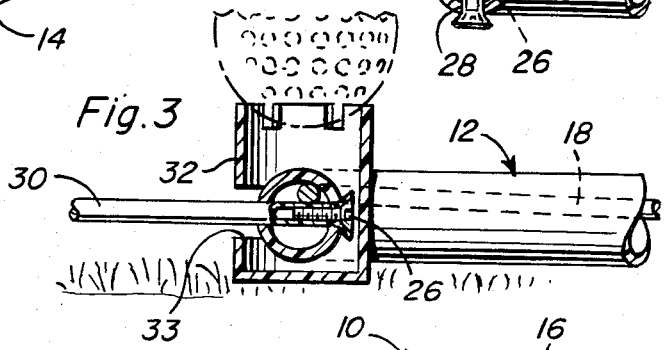
FIG. 3 is a view similar to FIG. 2, but taken on line 3—3 of FIG. 1.

As shown particularly in FIGS. 1–3, a golfing aid 10 comprises a guide structure in the form of an elongate flexible tube 12 of plastic, rubber, or the like, which is bent into the form of a U with elongate arms 14 and 16. Conveniently, the tube may be of about one-half inch diameter and just over 4 feet in length, so that the arms are each about 2 feet in length. A stiff wire 18 (FIGS. 2 and 3) extends through the tube to retain the tube in the configuration to which it is bent. The wire may be knotted at opposite ends of the tube to retain it longitudinally and end covers 20 and 22 may be provided.

Extending from each arm are a plurality of spaced indicator fingers 24, each finger comprising resilient rubber or plastic tubing having a length of about 5 inches. The fingers may be secured to tube 12 by inserting the fingers through diametric holes 28 formed in tube 12 and threading securing screws 26 into the ends of the fingers so as to spread the ends. Alternatively or additionally, the fingers may be secured in holes 28 by adhesive. The alignment of holes 28 is such that when the tube is bent into the U and placed on the ground, fingers 24 extend upwardly.

An additional finger 30, similar to fingers 28, is provided at the apex of tube 12 to form a pointer useful in aiming and positioning the device. An optional plastic cup-like member 32 is detachably mounted on tube 12 for use as a tee. The member 32 is tubular and provided with a notch 33 which enables it to snap onto tube 12 at any position such as at the pointer 30 in FIG. 3 so that the pointer 30 serves as an indicator to enable the golfer to more accurately swing the clubhead in the desired path. The member 32 can be removed completely, attached at any point or used as a separate tee.

Figure 4:
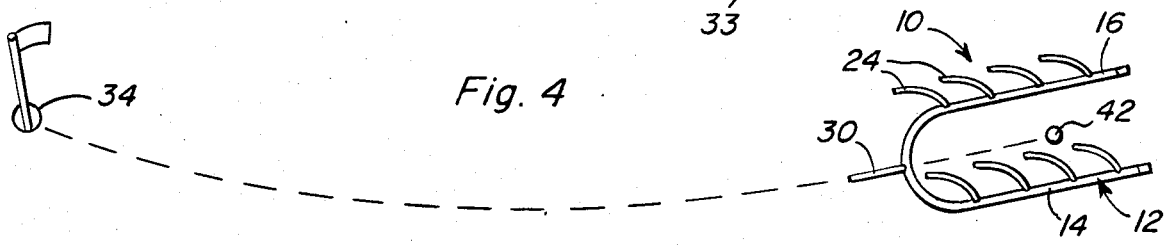
FIGS. 4–7 are diagrammatic plan views of the training aid showing different methods of using same.
Figure 5:
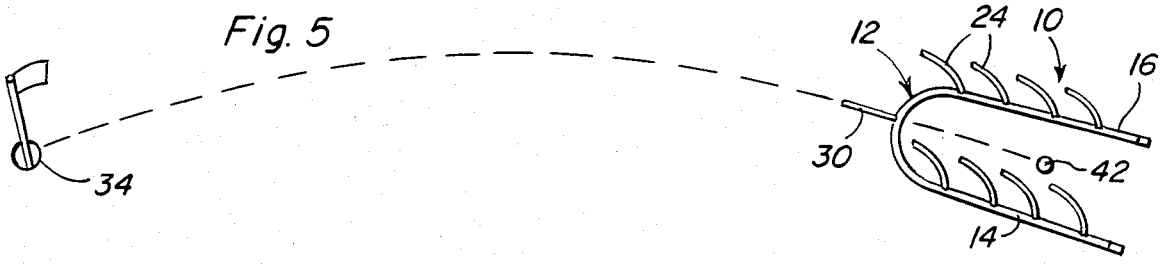
Figure 6:
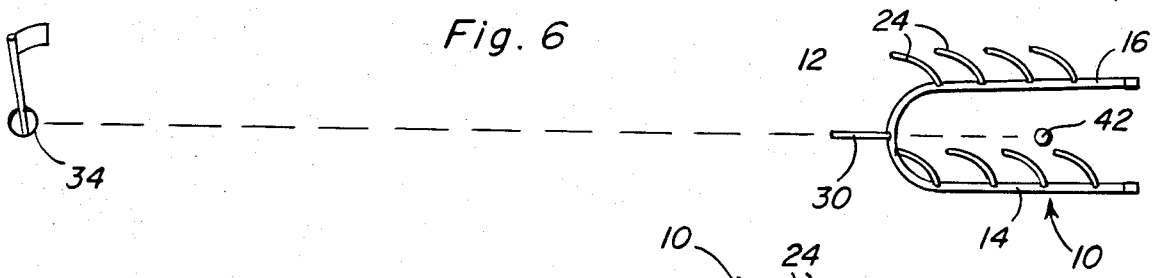

In use, a golfer may place the device on the ground and align it in relation to a golf ball 42 and a target 34 in manner providing clubhead swing path guidance for different types of shots. In each case, the device is placed so that the ball is between arms 14 and 16 with the apex of the U in advance of the ball. Pointer finger 30 is used to facilitate alignment of the device along an intended clubhead swing path. For example, as shown in FIG. 6, if the golfer desires to hit a straight shot toward the target, finger 30 is pointed straight at the target. If, however, (for a right-handed golfer) the golfer desires to hit a fade or slice the shot toward the target, finger 30 is pointed to the left of the target as shown in FIG. 4, and if the golfer desires to hit a draw or hook shot toward the target, finger 30 is pointed to the right of the target as shown in FIG. 5. In each case, arms 14 and 16 provide a guide for indicating the required club head swing path to attain the desired shape of shot. If the golfer brushes any of the indicator fingers 24 with the clubhead in performing the swing, this provides a tactile indication that the clubhead has not been swung in the correct path. Further, the stiffness of the fingers is preferably such that when moved by the club head, a finger will not return to its original position until the golfer has an opportunity to see which finger or fingers have been disturbed. This will assist in indicating the precise location of the swing path error.

The device can also be used without a ball in the manner described above, for practicing the attainment of a required swing path for different types of shots. Adjustments in the placement and orientation of the device may also be made to compensate for swing errors or individual swing tendencies so that a golfer may train himself or herself to groove a swing suited to particular shot situations. Further, the arms of the U-shaped tube can be opened out or narrowed down to suit a golfer's own particular needs. For example, a beginning golfer can spread the arms apart when first using the device and then move the arms closer together as golfing proficiency is gained.

Figure 7:
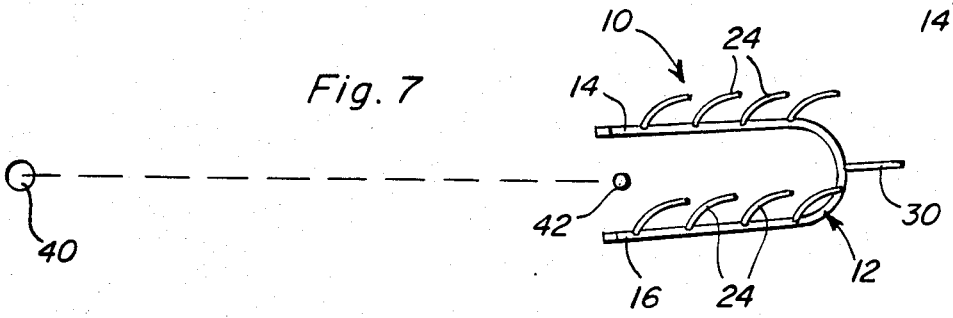

FIG. 7 shows the device being used in reverse as a putting or chipping aid, by hitting out of the U-shaped tube toward a hole or other target 40. In this case, arms 12 and 14 may be used as guides for grooving a putting or chipping stroke. Alternatively, the device may be used as a putting or chipping target by hitting into the U-shaped tube.

It will be appreciated that the invention provides a versatile golf training aid which is simple to manufacture and transport and which can be used by a golfer for diverse swing training purposes both outdoors and indoors.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. A golfing aid comprising a guide structure in the form of a U-shaped member having limbs defining a pair of elongate arms adapted for placement on the ground in juxtaposition to a golf ball location with the arms straddling the line of an intended clubhead swing path, the arms each including a plurality of resilient fingers extending upwardly therefrom when the structure is placed on the ground for providing indication to a golfer, when brushed by a clubhead, that the clubhead has strayed from the intended swing path.

2. The invention of claim 1 wherein the structure includes an additional resilient finger extending from the U-shaped member at the apex of the U for use in aligning the structure in relation to a target.

3. The invention of claim 2 wherein the U-shaped member comprises a flexible tube having a stiffening wire extending therethrough enabling the distance between the arms to be adjusted by bending the tube and wire.

4. The invention of claim 3 wherein the resilient fingers comprise lengths of tubing secured in diametrically extending holes formed in the U-shaped tube.

5. The invention of claim 4 wherein the lengths of tubing are each secured in said holes by a screw threaded into one end of the respective length of tubing.

6. The invention of claim 3 including a cup-shaped member releasably attached to said tube for use as a tee.

7. A golfing aid comprising a U-shaped member with elongate limbs spaced apart a distance sufficient to accommodate a golf club head therebetween and a plurality of flexible fingers spaced lengthwise of each limb so that when the member is placed on the ground the fingers extend upwardly from the limbs.

8. The invention of claim 7 including a further finger positioned substantially centrally of said member so as to extend upwardly from the apex of the member when placed on the ground.

9. The invention of claim 7 wherein the member comprises a tube having a ductile, bendable stiffening wire extending therethrough.

10. The invention of claim 9 wherein said fingers comprise lengths of tubing secured in diametrically disposed holes formed in said tube.

11. A golfing aid comprising a U-shaped guide structure defining a pair of elongate arms adapted to be positioned on the ground in juxtaposition to a golf ball location with the arms straddling an intended clubhead swing path, and resilient indicating means extending upwardly from each arm for providing an indication, when brushed by a clubhead, that the club head has strayed from the intended clubhead swing path.

12. The invention of claim 11 wherein the indicating means comprises a plurality of resilient fingers spaced along the length of each arm.

13. The invention of claim 11 wherein the guide structure comprises a tube bent into the form of a U to define said arms, the structure including a further centrally located resilient finger forming a pointer to facilitate aligning the aid in relation to an intended target.

* * * * *